US005819502A

United States Patent [19]

Kikuchi

[11] Patent Number: 5,819,502

[45] Date of Patent: Oct. 13, 1998

[54] SHIFTING APPARATUS FOR OBJECTS SUCH AS EGGS

[75] Inventor: Kohichi Kikuchi, Okayama-ken, Japan

[73] Assignee: Kyowa Machinery Co., Ltd., Okayama-ken, Japan

[21] Appl. No.: 852,908

[22] Filed: May 8, 1997

[30] Foreign Application Priority Data

May 9, 1996 [JP] Japan ..... 8-139485

[51] Int. Cl.[6] ..... B65B 35/36; B65G 47/52; B65G 47/90

[52] U.S. Cl. ..... 53/251; 53/142; 53/246; 53/247; 53/257; 53/539

[58] Field of Search ..... 53/251, 250, 249, 53/252, 257, 255, 260, 261, 247, 248, 246, 142, 539, 543

[56] References Cited

U.S. PATENT DOCUMENTS

| | | | |
|---|---|---|---|
| 3,374,600 | 3/1968 | Rademacher et al. | 53/251 X |
| 3,908,812 | 9/1975 | Graff | 53/543 X |
| 3,974,624 | 8/1976 | Bentley et al. | 53/246 X |
| 4,199,050 | 4/1980 | Moller | 53/247 X |
| 4,231,213 | 11/1980 | Okazaki | 53/539 X |
| 4,764,387 | 8/1988 | Willsey | 426/299 |
| 4,918,907 | 4/1990 | Roach et al. | 53/251 X |
| 4,965,981 | 10/1990 | Kikuchi | 53/142 |

*Primary Examiner*—James F. Coan
*Attorney, Agent, or Firm*—Merchant, Gould, Smith, Edell, Welter & Schmidt

[57] ABSTRACT

An apparatus is provided for shifting objects from a first conveyor to a container transferred by a second conveyor. The apparatus includes a holder guide, a displacing mechanism for moving the holder guide, a plurality of holders carried by the holder guide and spaced from each other for receiving the objects from the first conveyor. The holders are movable on the holder guide. A pitch changing mechanism is mounted for selectively causing the holders to move on the holder guide in response to the movement of the holder guide. A discharging mechanism causes the holders to discharge the received objects into the container. The pitch changing mechanism includes a first cam arranged adjacent to at least one of the holders for selectively causing the one of the holders to move on the holder guide. The pitch changing mechanism further includes a second cam held in contact with the first cam for positionally adjusting the first cam.

10 Claims, 8 Drawing Sheets

SHIFTING APPARATUS FOR OBJECTS SUCH AS EGGS

BACKGROUND OF THE INVENTION

1. Field of the Invention

The present invention generally relates to handling of objects, in particular easily damageable objects such as eggs and fruits (apples, peaches, and so on). It more specifically relates to an apparatus for shifting such objects from a conveyor to each of containers successively transferred by another conveyor.

2. Description of the Related Art

In automated handling of eggs for example, it is usual to employ a shifting apparatus which is used to shift, at each time, a predetermined number of eggs from a first conveyor into each of containers (plastic or paper packages) successively transferred on a second conveyor.

As is well known, egg containers have rows of seating recesses which are spaced by a constant pitch as viewed perpendicularly of the transferring direction of the containers. A typical shifting apparatus for transferring eggs into such a container includes a row (or rows) of holders which are also spaced by a constant pitch for receiving eggs from the first conveyor and discharging them onto each row (or corresponding rows) of seating recesses of the container. Generally, the above-mentioned constant pitch of the holders is determined accordingly to the specifications of the first conveyor.

On the other hand, pitches of the seating recesses of egg containers are rendered different from each other depending on the size or number of the eggs to be packed. Further, even when these size and number of the eggs are the same, the pitches of the seating recesses of egg containers may differ depending on container manufacturers.

Therefore, when using a single shifting apparatus (which has a fixed holder pitch for receiving the eggs from the first conveyor) for various egg containers (having different pitches of seating recesses) in turn, the shifting apparatus is required to have a pitch changing system for adjusting to the pitch of the seating recesses of each different egg container to properly discharge eggs into the container. Such a shifting apparatus is disclosed in U.S. Pat. No. 4,965,981 of the same assignee of the present invention.

However, in the shifting apparatus of the above U.S. patent (see FIG. 1), the adjusting device 29 for retractably projecting the rod 29*b* may need a rather complicated arrangement. Further, since the pitch changing member 23 and the cylinder rod 29*b* of the adjusting device 29 are mutually connected by a pin, it may be troublesome and time-consuming to replace the pitch changing member 23 for another having a different slanting guide surface. Still further, since the slanting guide surface 23*a* is a constantly inclined linear plane, vertical displacement with no horizontal movement is impossible by the holders of the U.S. patent.

SUMMARY OF THE INVENTION

It is, therefore, an objective of the present invention to provide a shifting apparatus for objects such as eggs, wherein a pitch changing mechanism is easily mounted and replaced, while also capable of causing the holders to perform various manners of pitch changing movement.

According to the present invention, there is provided an apparatus for shifting objects, such as eggs, from a first conveyor to each of containers transferred by a second conveyor, the apparatus comprising: a holder guide arranged between the first and second conveyors; a displacing mechanism for moving the holder guide between a first position and a second position; a plurality of holders carried by the holder guide and spaced from each other for receiving the objects from the first conveyor when the holder guide assumes the first position, the holders being movable on the holder guide and including two end holders; a pitch changing mechanism for selectively causing the holders to move on the holder guide in response to the movement of the holder guide; and a discharging mechanism for causing the holders to discharge the received objects into the container when the holder guide assumes the second position; wherein the pitch changing mechanism includes a first cam arranged adjacent to at least one of the end holders for selectively causing said one end holder to move relative to the other end holder as the holder guide is moved toward the second position; and wherein the pitch changing mechanism further includes a second cam held in contact with the first cam for positionally adjusting the first cam.

With such an arrangement, the first and second cams are not firmly connected but only held in contact with each other. Thus, it is possible to easily replace the first or second cam for another cam independently of the second or first cam. Further, it is also possible to cause the holders to perform various manners of pitch changing operations by properly configuring the profiles of the first and/or second cams.

Preferably, the first cam may have a smoothly continuous guide surface for controlling the movement of said one end holder relative to the other end holder. The guide surface of the first cam may include a flat portion. Advantageously, the guide surface of the first cam may include a curved portion which is smoothly continuous with the flat portion. The second cam may have a plurality of flat surfaces selectively brought into contact with the first cam by rotation about an axis. In this case, distances between the axis of the second cam and the respective flat surfaces are different to each other. Preferably, the rotation of the second cam may be performed by a knob.

Other objects, features and advantages of the present invention will be fully understood from the following detailed description given with reference to the accompanying drawings.

DETAILED DESCRIPTION OF THE PREFERRED EMBODIMENTS

Figure 7:
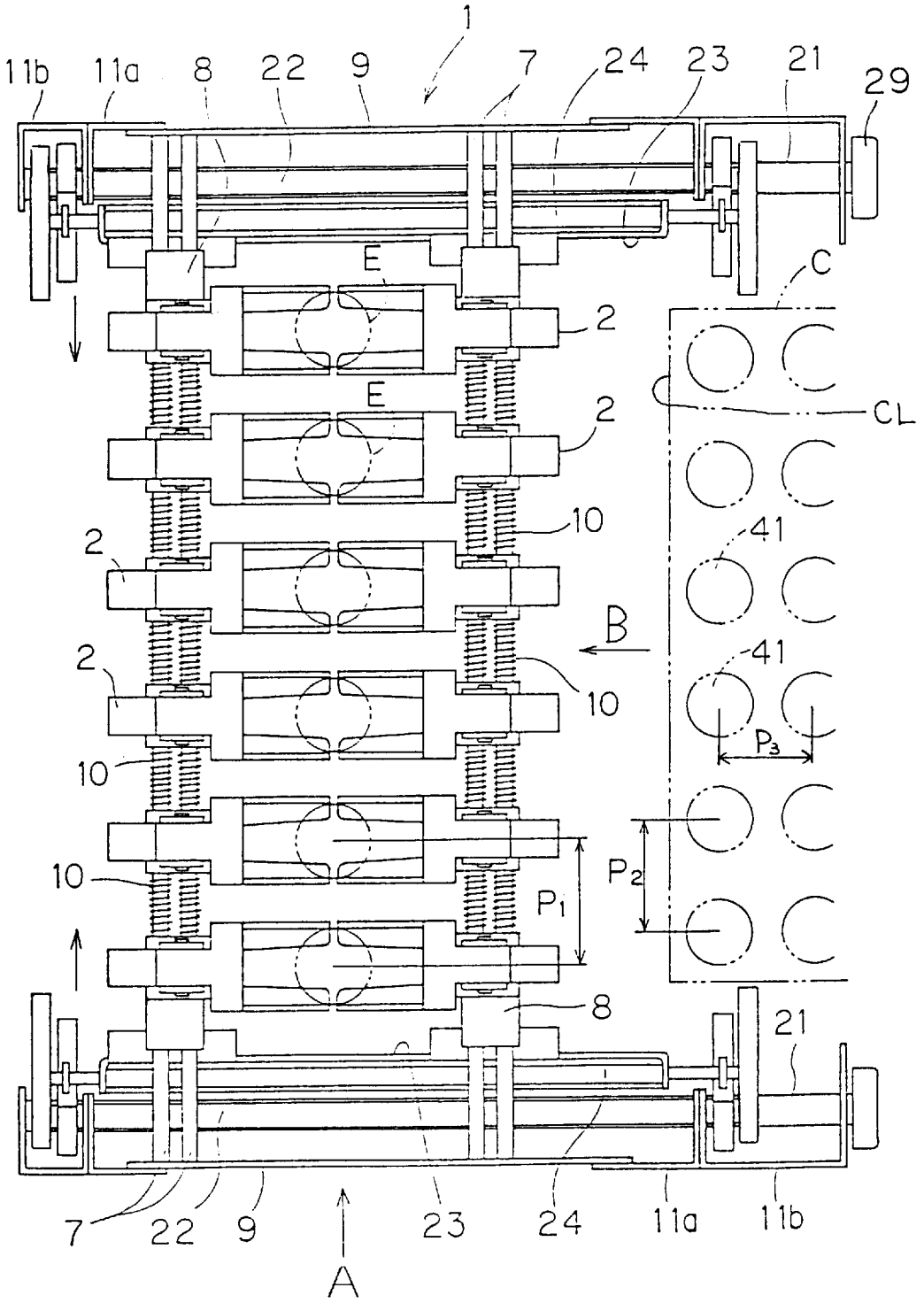
FIG. 7 is a plan view showing the shifting apparatus.
Figure 8:
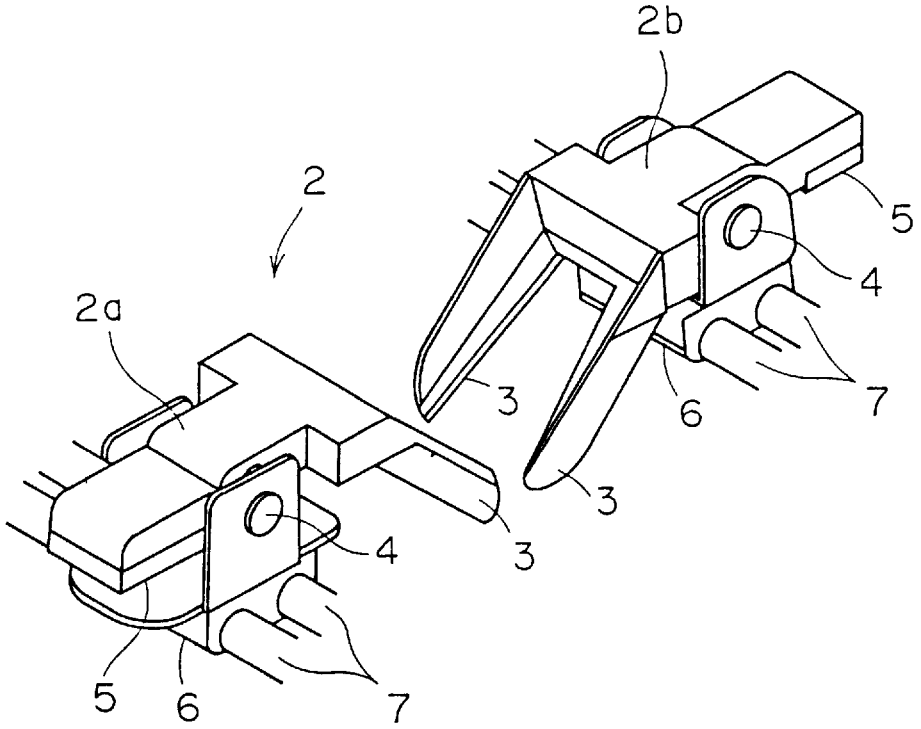
FIG. 8 is a perspective view showing a pair of holders.

Referring now to FIGS. 7 and 8 of the accompanying drawings, FIG. 7 illustrates a shifting apparatus 1 according to the present invention as used for handling eggs E as an example of easily damageable objects, whereas FIG. 8 shows a holder 2, which itself is of a known type. The holder 2 is designed to receive an egg from an upper conveyor for example, and to discharge it into a container below transferred by a lower conveyor for example. As shown in FIG. 8, the holder 2 includes a pair of holder members 2*a* and 2*b*, each of which has a fork arm portion 3, a return weight 5 and a support 6. The fork arm portion 3, which is mounted on the support 6 for pivotal movement about a pin 4, is caused to pivot downward by a suitable drive means (not shown) for discharging the egg into the unillustrated egg container.

In the illustrated embodiment, six holders 2 are slidably mounted on two pair of horizontal guide shafts 7, as is best shown in FIG. 7. Each horizontal guide shaft 7 is connected at its both ends to respective side plates 9 which are vertically movable. Each pair of guide shafts 7 slidably mounts two fixing members 8 each being disposed outwardly adjacent to a corresponding outermost holder (end holder) 2.

Compression coil springs 10 are mounted around the shafts 7 in an interposed manner between the respective holders 2. At the time of receiving the eggs E, these springs function to maintain even spacing or pitch P1 of the holders 2, while also adjusting the pitch P1 to be equal to a pitch between each adjacent cups on the unillustrated upper conveyor for transferring eggs to the respective holders 2. Reference numeral 11*a* indicates an inner frame, whereas reference numeral 11*b* indicates an outer frame. Though the illustrated embodiment utilizes six holders 2, it is also possible to use only some of them (three holders for example).

The shifting apparatus 1 is located below the upper conveyor which transfers eggs E in the direction of an arrow A shown in FIG. 7, and receives the eggs E with the holders 2. On the other hand, the container C is transferred in the direction of an arrow B by an unillustrated lower conveyor until it is brought into a predetermined place under the shifting apparatus 1. Then, the holders 2 are lowered to discharge the eggs E into the first row of seating recesses 41 which are disposed adjacently along a leading edge CL of the container C. Thereafter, the holders 2 are moved upward back to the initial position to receive the next row of eggs, whereas the container C is transferred in the direction B only by a pitch $P_3$ which is defined between the centers of two seating recesses 41 disposed adjacently in the direction B. The container C remains there, waiting for the next row of eggs to be discharged thereinto.

Referring to FIGS. 1–6, there is illustrated a pitch changing mechanism of the present invention. The mechanism includes a first cam 26 and a second cam 28 held in contact with the first cam for positional adjustment thereof. As will be described below, the first cam 1 is formed with a guide surface profiled suitably for causing the holders 2 to move in a predetermined manner on the holder guide shafts 7 in response to the vertical movement of the holder guide shafts 7.

FIGS. 1–2 and 4–6 show only one pitch changing mechanism for convenience of illustration. However, advantageously, four pitch changing mechanisms are provided at the respective four corners of the shifting apparatus 1, as shown in FIG. 7. Alternatively, it is also possible to provide only two pitch changing mechanisms disposed on the respective pairs of guide shafts 7 (the upper two mechanisms in FIG. 7 for example).

Reference numeral 21 indicates an adjusting shaft which is rotatably connected at its both ends to the respective frames 11*b* (see also FIG. 7), whereas reference numeral 22 indicates a pivot shaft which is located above the adjusting shaft 21 and pivotally connected at its both ends to the respective frames 11*a*. Both of the shafts 21 and 22 extend perpendicularly of the guide shafts 7.

Reference numeral 23 indicates a pull-plate, which is attached to corresponding fixing members 8 and rotationally supports a drive shaft 24 extending perpendicularly of the guide shafts 7. The drive shaft 24 rotationally carries cam followers 25 at its both ends. The cam follower may be a suitable roller for example.

Figure 3:
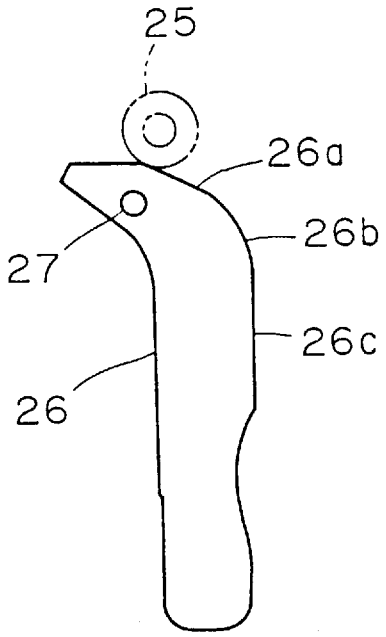
FIG. 3 is a side view showing a first cam used in the pitch changing member.

The first cam 26 is pivotally connected at an upper portion thereof to the frame 11*a* via a pin 27. As is best shown in FIG. 3, the first cam 26 has a back portion or a guide surface (26*a*–26*c*) along which the cam follower 25 is guided. When the first cam 26 assumes the upright position shown in FIG. 3, the back portion of the first cam 26 includes a first flat portion 26*a* which descends inward (rightward), a curved surface 26*b* smoothly connected to the first flat portion 26*a* and a second flat portion 26*c* smoothly extending downward from the curved surface 26*b*.

Figure 1:
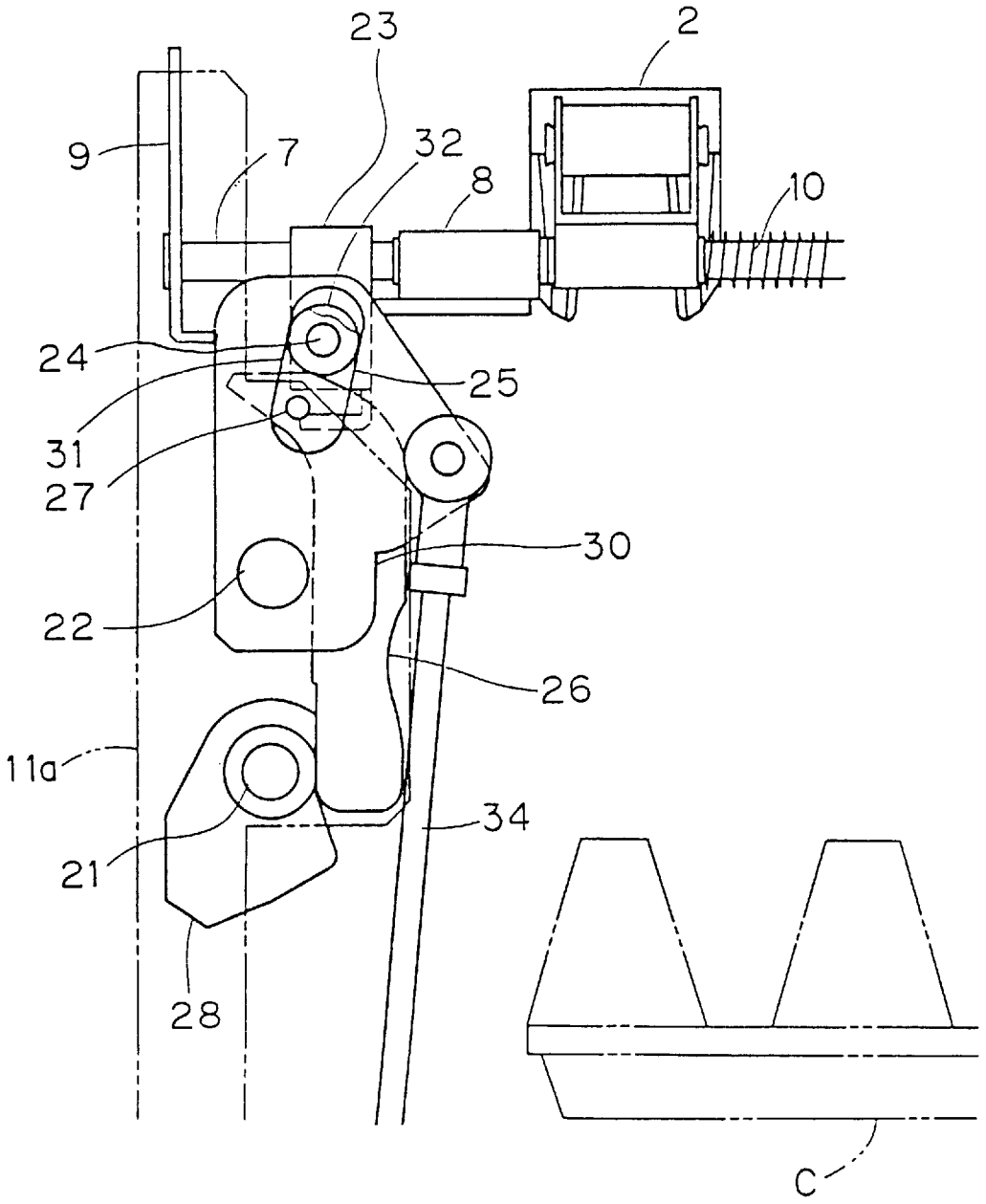
FIG. 1 is a side view showing a pitch changing member of a shifting apparatus according to the present invention in a waiting state for receiving a large-size egg.

As shown in FIG. 1 for example, the lower left portion of the first cam 26 is held in contact with the second cam 28 for adjusting the inclination angle of the first cam 26. The second cam 28 is connected to the adjusting shaft 21. A knob 29 is connected to the shaft 21 at one end thereof (see FIG. 2) for rotating the shaft 21.

The second cam 28 has a plurality of flat surfaces selectively brought into contact with the first cam 26 by suitably rotating the knob 29 (consequently the adjusting shaft 21 on which the second cam 28 is fixed). Since the distances between the adjusting shaft 21 and the respective flat surfaces of the second cam 28 are rendered different from each other, as shown in FIG. 1, the inclination angle of the first cam 26 (relative to the adjusting shaft 21 for example) is varied by manually causing the different flat surfaces of the second cam 28 to contact with the first cam 26 in turn. The rotating operation to the knob 29 may be performed by an electrically driven means for example.

With such an arrangement, the first cam 26 and second cam 28 are replaced easily and independently of each other, since they are not mutually connected but only held in contact with each other. Further, as described hereinafter, by forming the profiles of the first and/or second cams into suitable configurations, it is possible to cause the holders 2 to follow various loci as the holders 2 are moved vertically.

Figure 2:
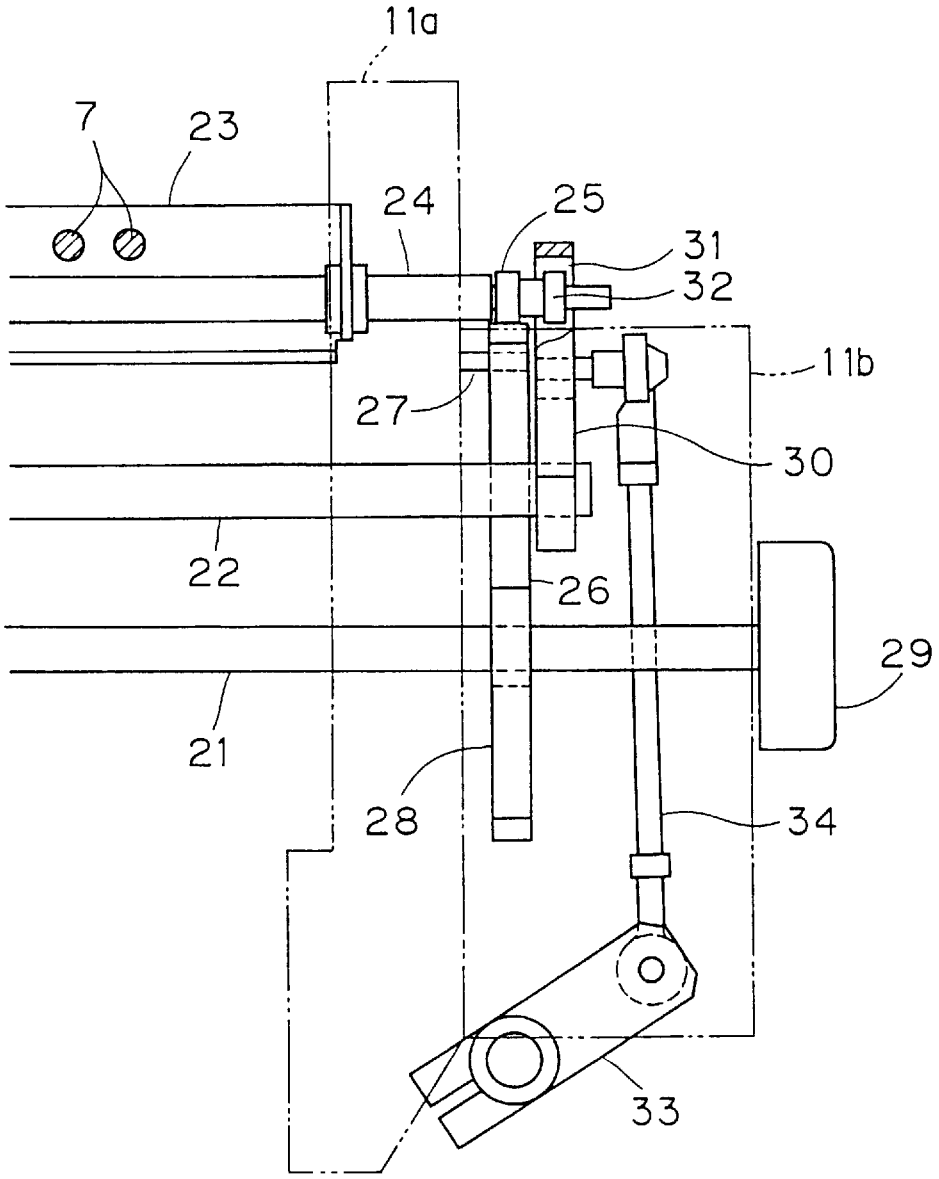
FIG. 2 is a front view showing the same pitch changing member shown in FIG. 1.

Reference numeral 30 indicates a drive plate connected at its lower portion to an end of the pivot shaft 22 (see FIG. 2). As shown in FIG. 1, the drive plate 30 has an upper portion formed with an elongated through-hole 31 descending outward (leftward) in the figure. The elongated through-hole 31 receives a guide roller 32 in movable engagement therewith. The guide roller 32 is attached to the drive shaft 24 adjacent to but outward of the cam follower 25. In the illustrated embodiment, the diameter of the guide roller 32 is equal to that of the cam follower 25.

Reference numeral 33 (see FIG. 2) indicates a crank arm driven by e.g. an external motor (not shown). A rod 34 is pivotally connected at its lower end to the crank arm 33, whereas the upper end of the rod 34 is pivotally connected to a nose-like portion (the rightward protruding portion in FIG. 1) of the drive plate 30.

With such an arrangement, upon pivotal movement of the crank arm 33, the rod 34 is caused to reciprocate vertically. When the rod 34 is caused to move downward, the drive plate 30 moves clockwise about the pivot shaft 22, while the guide roller 32 is displaced within the elongated through-hole 31, so that the drive shaft 24 is also moved clockwise along the guide surface (26*a*–26*c*) of the first cam 26. As a result of this movement of the drive shaft 24, the pull-plate 23 (and consequently the outermost holder 2) is moved on the guide shafts 7 toward the other outermost holder 2 (rightward in FIG. 1) so that the pitch $P_1$ between the holders 2 is equalized to the pitch $P_2$ of the seating recesses 41 at the time of discharging the eggs E into the container C.

It should be noted that, according to the present invention, the pitch $P_1$ can be arranged to become larger as the holders 2 are lowered by forming the guide surface of the first cam 26 into a suitable profile.

The frame 11*b* may be provided with e.g. a scale on a side surface thereof corresponding to the knob 29, whereas the knob 29 may have a pointer which collaborates with the scale. These scale and pointer are utilized to show how much the knob 29 (and consequently the second cam 28) should be rotated to set the first cam 26 at a proper position for the purpose of causing the holders 2 to provide a suitable discharging pitch therebetween.

When eggs E to be handled are of a large-size for instance, the pitch $P_2$ of the container C is rendered large, and therefore the pitch $P_1$ of the holders 2 at the time of discharging the eggs should be also large. In such a case, the first cam 26 is brought into an upright position with the first flat portion 26*a* descending inward and the second flat portion 26*c* extending vertically, as shown in FIG. 1, by adjusting the cam 28 for bringing a suitable flat surface of the cam 28 into contact with the lower left portion of the first cam 26. When the holders 2 are located at the upper position to receive the eggs E, as shown in FIG. 1, the cam follower 25 is located at a starting point (the left end) of the first surface 26*a*.

When the rod 34 begins to move downward, the cam follower 25 received in the through-hole 31 of the drive plate 30 is also moved downward together with the drive shaft 24, while guided along the first flat portion 26*a* of the first cam 26. As a result, the pull-plate 23, which is connected to the drive shaft 24, is moved toward the opposite end holder 2 and downward simultaneously Then, as the rod 34 is further moved downward, the cam follower 25 is guided onto the curved surface 26*b* and further onto the second flat portion 26*c*. The first and second flat portions 26*a* and 26*c* are smoothly connected to the curved surface 26*b*, the movement of the cam follower 25 along these surfaces is smoothly performed. In this way, the pitch $P_1$ between each two adjacent holders 2 is reduced as the holders 2 are lowered.

Figure 4:
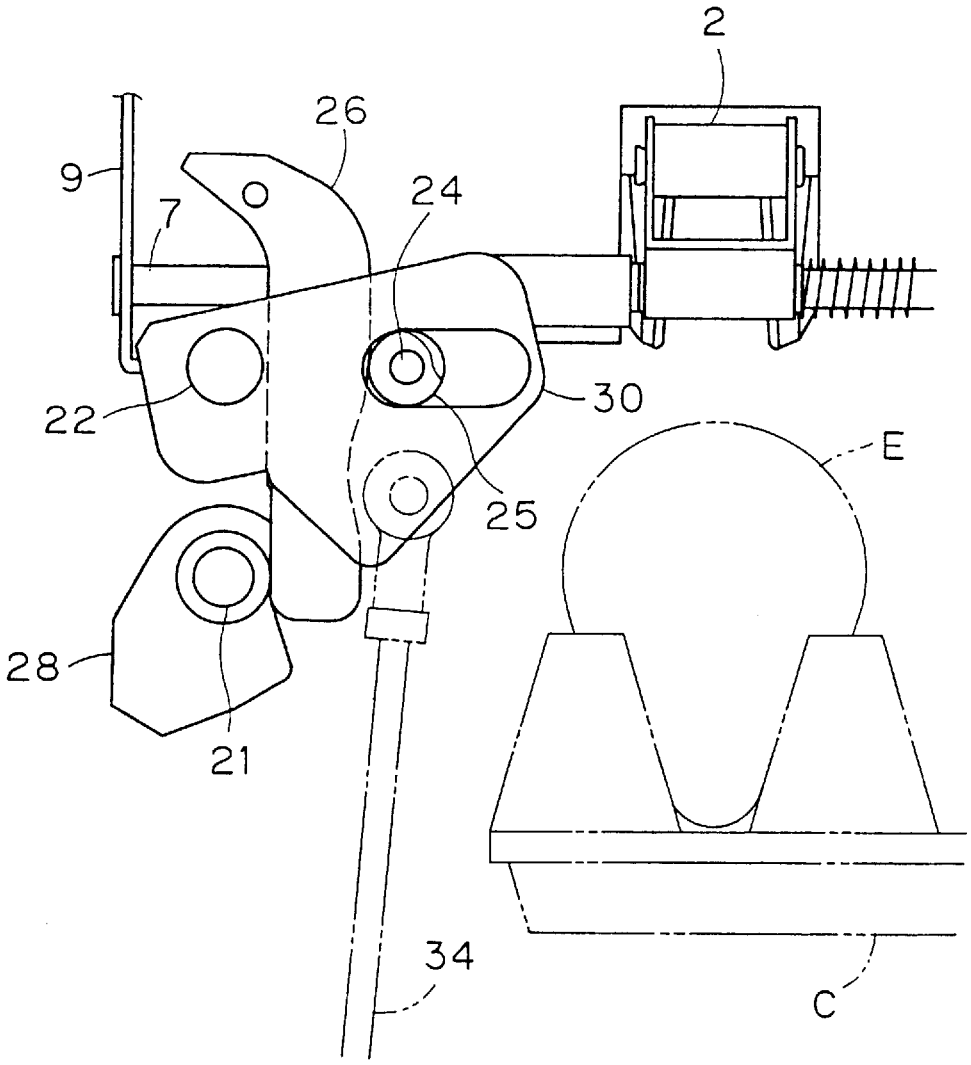
FIG. 4 is a side view illustrating the shifting apparatus at the time of discharging a large-size egg.

FIG. 4 shows the holder 2 which is held at the lowest position where the egg E is discharged into the container C. In the illustrated embodiment, the second flat portion 26*c* of the first cam 26 extends vertically. Therefore, when the cam follower 25 is guided down along the second flat portion 26*c*, the pitch $P_1$ of the holders 2 remains at a constant value which is equal to the pitch $P_2$ of the seating recesses 41 of the container C.

With such an arrangement, the necessary horizontal displacement of the end holder 2 is obtained upon completion of displacement along the first and curved surfaces 26*a* and 26*b*. In this way, the pitch $P_1$ of the holders 2 is changed to the desired value, that is, the pitch $P_2$ of the seating recesses 41 of the container C. After the earlier stage of displacement, the holders 2 are lowered only vertically until the eggs E are discharged. Thereafter, when the rod 34 is upwardly moved, the cam follower 25 is caused to move along the same path taken before in the reverse manner, so that the holder 2 returns to the original position (FIG. 1).

Figure 5:
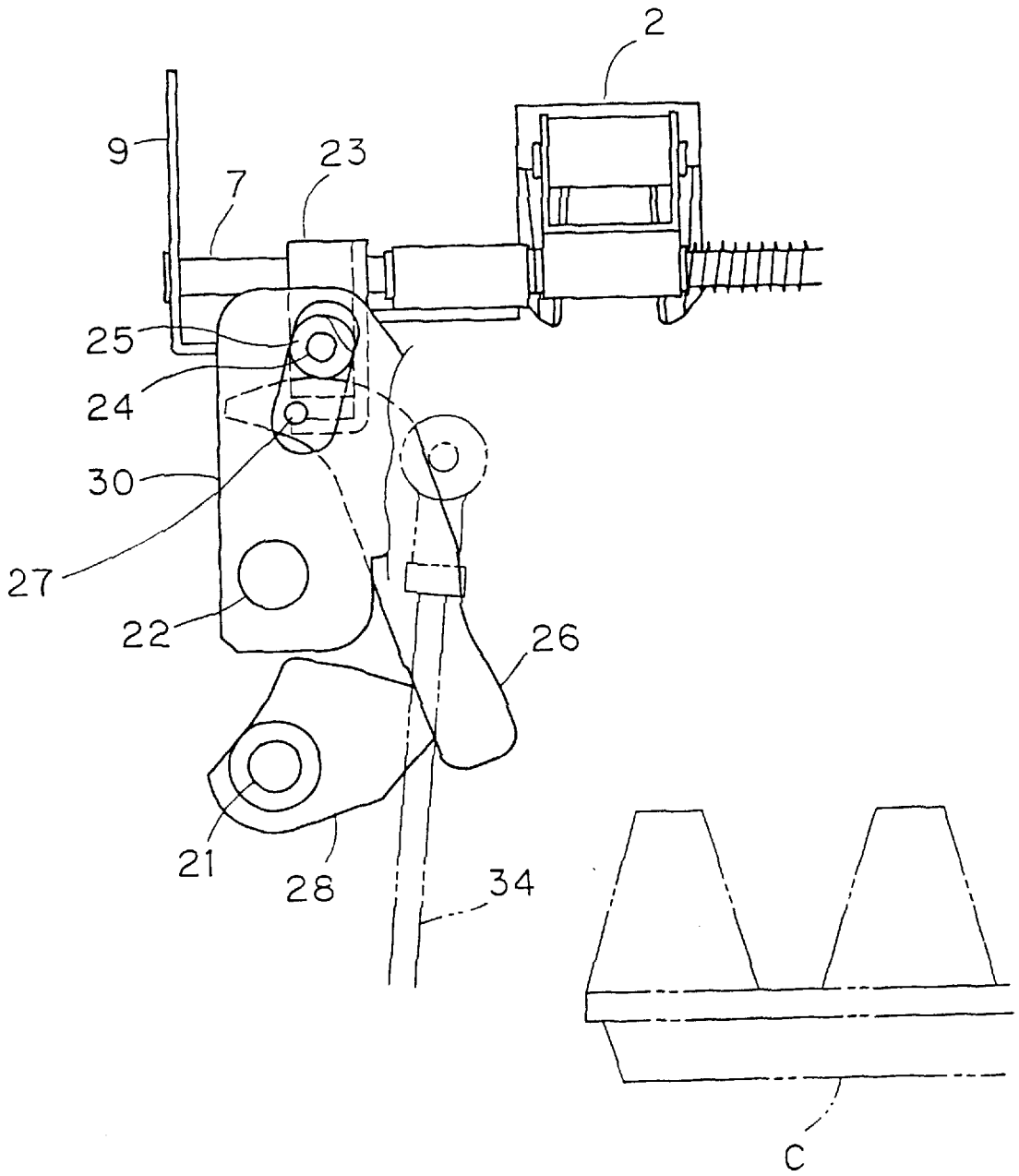
FIG. 5 is a side view showing the shifting apparatus in a waiting state for receiving a small-size egg.
Figure 6:
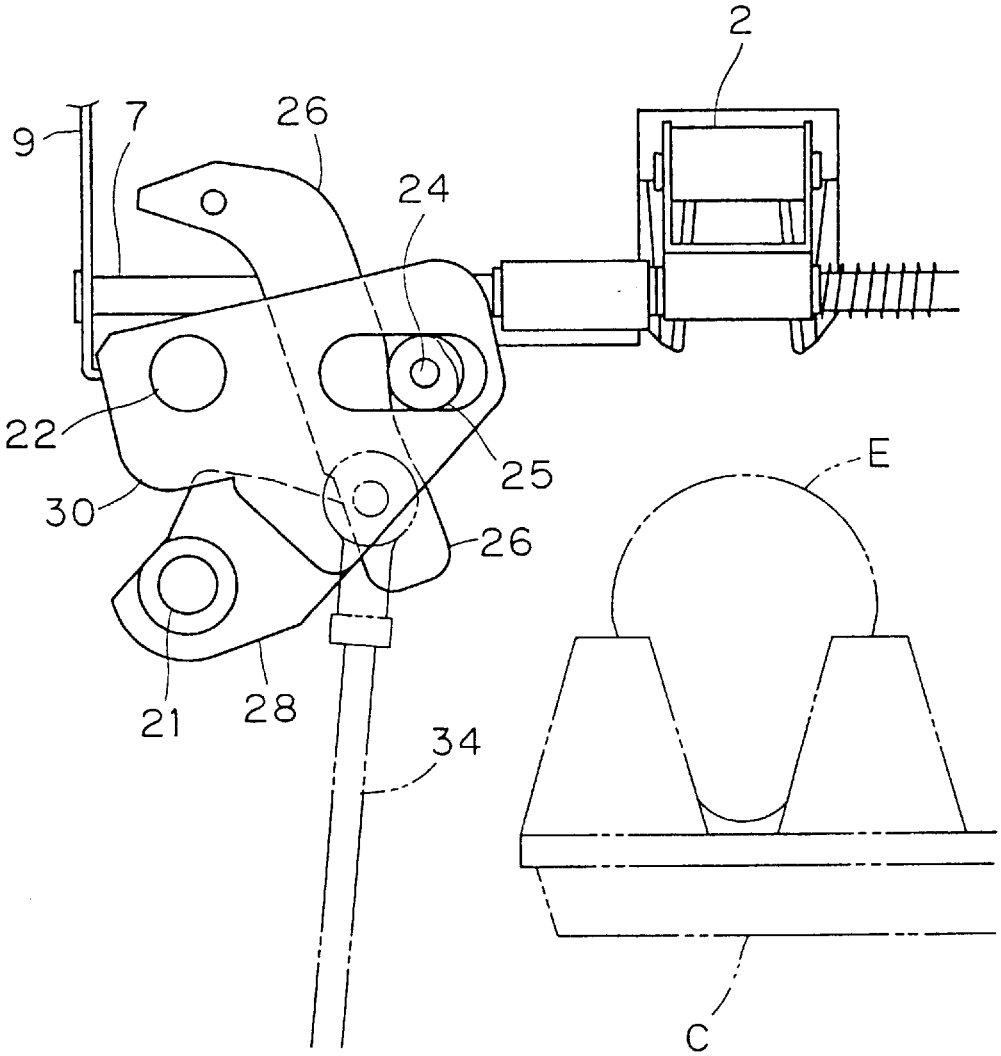
FIG. 6 is a side view illustrating the shifting apparatus at the time of discharging a small-size egg.

FIGS. 5 and 6 illustrate an instance where the eggs to be handled are of a small size. In this case, the first cam 26 is pivotally displaced about the pin 27 in a manner such that the lower portion of the first cam 26 is further away rightward from the shaft 21. For holding the first cam 26 at this position, the second cam 28 is held in contact with the first cam at a cam surface different from the surface illustrated in FIG. 1. As shown in FIG. 5, the cam follower 25 is initially held in contact with the first flat portion 26*a* which extends substantially horizontally.

With such an arrangement, upon downward movement of the rod 34, the cam follower 25 is moved away from the first surface 26*a* and onto the curved surface 26*b*, and then onto the second flat portion 26*c*, which is now inclined relative to the vertical direction. In the illustrated instance again, an appropriate amount of horizontal displacement of the cam follower 25 (and consequently the end holder 2) is obtained at an earlier stage, that is, while the cam follower 25 is guided along the first flat portion 26*a* and curved surface 26*b*. Thus, the pitch $P_1$ of the holders 2 is sufficiently reduced at the earlier stage of the egg shifting operation. Thereafter, the holders 2 are further moved downward while the cam follower 25 is guided along the second flat portion 26*c*, until the egg E is discharged into the container C, as shown in FIG. 6.

According to the present invention, the pitch $P_1$ of the holders 2 is reduced at an earlier stage during the descending movement of the holders 2, and the latter stage of the movement is performed in a vertical or slightly inclined (substantially vertical) manner, as described above. Such an arrangement is advantageous in that the discharging operation of the eggs into the container C is performed after the holders 2 are (substantially) vertically moved along the second flat portion 26*c* of the first cam 26, since the discharging operation is more easily and reliably performed in this way.

The preferred embodiment of the present invention being thus described, it is obvious that the same may be varied in many ways. Such variations are not to be regarded as a departure from the spirit and the scope of the present invention, and all such modifications as would be obvious to those skilled in the art are intended to be included within the scope of the following claims.

I claim:

1. An apparatus for shifting objects from a first conveyor to each of containers transferred by a second conveyor, the apparatus comprising:

a holder guide arranged between the first and second conveyors;

a displacing mechanism for moving the holder guide between a first position and a second position;

a plurality of holders carried by the holder guide and spaced from each other for receiving the objects from the first conveyor when the holder guide assumes the first position, the holders being movable on the holder guide and including two end holders;

a pitch changing mechanism for selectively causing the holders, to move on the holder guide in response to the movement of the holder guide; and a discharging mechanism for causing the holders to discharge the received objects into the container when the holder guide assumes the second position;

wherein the pitch changing mechanism includes a first cam arranged adjacent to at least one of the end holders for selectively causing said one end holder to move relative to the other end holder as the holder guide is moved toward the second position; and wherein the pitch changing mechanism further includes a second cam held in contact with the first cam for positionally adjusting the first cam.

2. The apparatus according to claim 1, wherein the first cam has a smoothly continuous guide surface for controlling the movement of said one end holder relative to the other end holder.

3. The apparatus according to claim 2, wherein the guide surface of the first cam includes a flat portion.

4. The apparatus according to claim 2, wherein the guide surface of the first cam includes a curved portion which is smoothly continuous with the flat portion.

5. The apparatus according to claim 1, wherein the second cam has a plurality of flat surfaces selectively brought into contact with the first cam, the second cam being rotated about an axis.

6. The apparatus according to claim 5, wherein distances between the axis of the second cam and the respective flat surfaces are different from each other.

7. The apparatus according to claim 5, wherein the rotation of the second cam is performed by a knob.

8. The apparatus according to claim 2, wherein said one end holder is connected to a pull-plate carrying a rotatable drive shaft extending transversely of the holder guide, the drive shaft having an end provided with a cam follower which is guided by the guide surface of the first cam as the holder guide is moved.

9. The apparatus according to claim 8, wherein the drive shaft further carries a guide roller disposed adjacent to the cam follower, the displacing mechanism including a drive plate operable for moving the drive shaft, the drive plate formed with an elongated through-hole for receiving the guide roller of the drive shaft.

10. The apparatus according to claim 9, wherein the guide roller and the cam follower are equal in outer diameter.

* * * * *